United States Patent [19]

Inoue et al.

[11] Patent Number: 5,077,169

[45] Date of Patent: Dec. 31, 1991

[54] TONER COMPOSITION AND A METHOD FOR PREPARING THE SAME

[75] Inventors: Masahide Inoue, Nara; Koichi Tsuyama, Kobe; Yoshitake Shimizu, Kyoto, all of Japan

[73] Assignee: Mita Industrial Co., Ltd., Osaka, Japan

[21] Appl. No.: 424,645

[22] Filed: Oct. 20, 1989

[30] Foreign Application Priority Data

Oct. 21, 1988 [JP] Japan ..... 63-266704

[51] Int. Cl.[5] ..... G03G 9/00; G03G 5/00

[52] U.S. Cl. ..... 430/110; 430/109; 430/111; 430/137

[58] Field of Search ..... 430/110, 111, 137, 109

[56] References Cited

U.S. PATENT DOCUMENTS 4,395,485 6/1983 Kashiwagi et al. ..... 430/110 X
4,949,127 8/1990 Matsuda et al. ..... 430/122 X

FOREIGN PATENT DOCUMENTS 0207628 7/1987 European Pat. Off. .
0186851 9/1985 Japan ..... 430/111
0186875 9/1985 Japan ..... 430/111

OTHER PUBLICATIONS

"Toner Mixture to Reduce Background Transfer Effects", Stephen Pond, Xerox Disclosure Bulletin, vol. 2, No. 5, Sep./Oct. 1977, p. 17.

*Primary Examiner*—Marion E. McCamish
*Assistant Examiner*—Stephen C. Crossan
*Attorney, Agent, or Firm*—Armstrong, Nikaido, Marmelstein, Kubovcik, & Murray

[57] ABSTRACT

A toner composition is disclosed which comprises a mixture of toner particles with finely powdered acylic polymer, and finely powdered silica dispersed in the mixture, wherein the finely powdered acrylic polymer is present in an amount of 0.05 to 0.15 parts by weight per 100 parts by weight of the toner particles and the weight ratio of silica to acrylic polymer is within the range of 1 to 5:1. Also disclosed is a method for preparing the toner composition.

9 Claims, No Drawings

TONER COMPOSITION AND A METHOD FOR PREPARING THE SAME

BACKGROUND OF THE INVENTION

1. Field of the invention

The present invention relates to a toner composition for use in a developer for the development of electrostatic latent images, and more particularly, the invention relates to a toner composition with excellent charge stability, flowability, feedability to the developing unit, and cleanability from the photosensitive means. The present invention also relates to a method for preparing the toner composition.

2. Description of the prior art

Previously, in copying machines utilizing electrophotography, an electrostatic latent image is formed on the photosensitive means which has a photosensitive layer containing inorganic or organic photoconductive materials, and various types of powder toners comprising a resinous binder and additives such as colorants dispersed therein have been used in order to visualize the electrostatic latent image by dry development.

In the above-mentioned electrophotographic processes, the electrostatic latent image formed on the photosensitive means by the sequence of charge and exposure is developed with the powder toner, thereby forming a toner image corresponding to the electrostatic latent image, and this toner image is then transferred to a support such as transfer paper, and finally the toner image is fixed onto the support by use of a fixing means such as a heating or pressurizing roller, thus obtaining the desired copy. After the toner image has been transferred to the support, the surface of the photosensitive means is cleaned by scraping with a cleaning blade in order to remove the residual toner.

In order to achieve satisfactory image formation in the above type of system, the characteristics of the toner must satisfy various requirements with respect to every phase of the imaging process, that is, stable charge retention, maintenance of superior development characteristics such as the absence of fogging or aerial scattering, no adhesion of residual toner on the surface of the photosensitive means in the cleaning process, etc.

Accordingly, in recent years, in Japanese Laid-Open Patent Publication No. 60-186851 and elsewhere, techniques have been proposed for improving charge stability and cleaning characteristics by use of a toner composition containing acrylic polymers in finely powdered form.

However, the toner composition proposed in the Japanese Laid-Open Patent Publication No. 60-186851, consisting merely of toner particles with an externally added fine acrylic polymer powder, still fails to have a satisfactory flowability. In particular, when applied to the continuous or high speed duplication of a large number of frames under high humidity conditions, the decrease in flowability causes toner scattering or image fogging in some cases.

Moreover, the developing units employed in recent types of copying machines are generally so constructed that toner replenished from a toner cartridge is accommodated in a container called a hopper, a feed roller composed of a porous or elastic material such as sponge is fitted in the bottom of the hopper, and the rotation of this feed roller allows toner to drop into the developer mixing unit to replenish the amount consumed, whereupon the toner is charged again and fed to the developing sleeve. However, if the proposed toner composition mentioned above is applied to this type of process, because of poor flowability, the toner composition may not drop despite the rotation of the feed roller. Moreover, this drawback becomes extremely pronounced under high humidity conditions.

SUMMARY OF THE INVENTION

The toner composition of this invention, which overcomes the above-discussed and numerous other disadvantages and deficiencies of the prior art, comprises a mixture of toner particles with finely powdered acrylic polymer, and finely powdered silica dispersed in the mixture, wherein the finely powdered acrylic polymer is present in an amount of 0.05 to 0.15 parts by weight per 100 parts by weight of the toner particles and the weight ratio of silica to acrylic polymer is within the range of 1 to 5:1.

In a preferred embodiment, the acrylic polymer is present in an amount of 0.08 to 0.13 parts by weight per 100 parts by weight of the toner particles.

In a preferred embodiment, the weight ratio of silica to acrylic polymer is within the range of 2.5 to 3.5:1.

In a preferred embodiment, the toner particles have a mean particle size of 1 to 30 μm.

In a preferred embodiment, the finely powdered acrylic polymer has a mean particle size of 0.3 to 1.0 μm.

In a preferred embodiment, the finely powdered silica has a mean primary particle size of 0.01 to 0.04 μm.

The method for preparing a toner composition of this invention comprises the steps of: (a) adding a finely powdered acrylic polymer to toner particles and mixing them with each other to form a toner mixture, the weight ratio of toner particles to acrylic polymer being within the range of 30 to 50:1; (b) diluting the toner mixture with additional toners to obtain a concentration of acrylic polymer ranging from 0.05 to 0.15 parts by weight per 100 parts by weight of the toner particles; and (c) adding finely powdered silica to the toner mixture so diluted and mixing them with each other to form the toner composition, the weight ratio of silica to acrylic polymer being within the range of 1 to 5:1.

In a preferred embodiment, the toner mixture obtained in the step (a) is diluted to obtain a concentration of acrylic polymer ranging from 0.08 to 0.13 parts by weight per 100 parts by weight of the toner particles.

In a preferred embodiment, the finely powdered silica is added to the toner mixture formed in the step (b) at a weight ratio of silica to acrylic polymer ranging from 2.5 to 3.5:1.

Thus, the invention described herein makes possible the objectives of (1) providing a toner composition in which the finely powdered acrylic polymer is maintained in a uniform state of dispersion, so that the flowability can always be satisfactory and the cleanability and charge stability can significantly be improved; (2) providing a toner composition which can continue to form clear, sharply copied images over a long period of time; (3) providing a toner composition which undergoes no changes in various characteristics even during long periods of continuous copying; (4) providing a toner composition with superior moisture resistance, which undergoes little change in various characteristics and permits smooth feeding by the feed roller from the toner hopper even under conditions of high humidity; (5) providing a toner composition which is easily removed and does not cling to the surface of the photosensitive means in the cleaning process; and (6) providing a method for producing a toner composition with the superior characteristics mentioned above.

DESCRIPTION OF THE PREFERRED EMBODIMENTS

In the present invention, a toner mixture is first prepared by adding finely powdered acrylic polymer to toner particles and mixing them with each other at a weight ratio of toner particles to acrylic polymer ranging from 30 to 50:1. Then, additional toner particles are added to and mixed with this toner mixture, thus diluting the content of the finely powdered acrylic polymer to a prescribed concentration relative to the toner particles. This method permits the uniform adhesion of the finely powdered acrylic polymer to the surfaces of the toner particles and the uniform dispersion of the acrylic polymer.

That is, when the above-described initial amount of finely powdered acrylic polymer is added to the toner particles, a portion of the finely powdered acrylic polymer adheres strongly to the toner particles, while the remainder of this fine powder remains in a state of weak adhesion. When the additional toner particles in a prescribed amount are added to this mixture, the additional toner particles adsorb this weakly adhering acrylic polymer, thus, a uniform overall state of dispersion can be maintained, without agglomeration or other manifestations of poor dispersion.

These facts will be more explicitly demonstrated by the examples and comparative examples described below. If the total amount of toner particles is mixed with the finely powdered acrylic polymer in a single operation, uniform dispersion is not achieved, and consequently when the toner composition prepared in this manner is used in a copying machine, the efficiency of feeding from the hopper deteriorates markedly. Moreover, when a running copy is being processed, reversely polarized toner is formed and scattering of toner occurs.

Next, in the present invention, the mixture of toner particles and finely powdered acrylic polymer obtained as stated above is further mixed with finely powdered silica at a weight ratio of silica to acrylic polymer ranging from 1 to 5:1. If the specified amount of finely powdered silica is added, the finely powdered acrylic polymer can be maintained in a uniform state of dispersion for a prolonged period of time. Moreover, excellent flowability is imparted to the toner composition, permitting maintenance of satisfactory feeding from the hopper and stable charging over an extended period of time. Furthermore, no deterioration of characteristics occurs even under conditions of high humidity. In the present invention, the addition of the finely powdered silica after the preparation of the toner mixture containing finely powdered acrylic polymer which is dispersed uniformly in the toner particles is important. As will be clearly demonstrated by the comparative examples described below, if the finely powdered acrylic polymer and the finely powdered silica are simultaneously added to the toner particles, agglomeration of the finely powdered acrylic polymer occurs, so that the feeding characteristics deteriorate and poorly charged particles are formed. That is, if the prescribed amount of finely powdered silica is added to and dispersed in the toner mixture with a uniform dispersion of finely powdered acrylic polymer, the toner particles with finely powdered acrylic polymer uniformly adhering to their surfaces are further covered by the finely powdered silica. Therefore, the finely powdered acrylic polymer is more stably maintained in a uniform state of dispersion, and the overall flowability of the toner composition is thereby increased.

The finely powdered acrylic polymer that is employed in this invention can be in the form of powder consisting of spherical resin particles obtained by emulsion polymerization, soap-free polymerization, dispersion polymerization, or suspension polymerization, etc., or can be in the form of fine powder obtained by the mechanical crushing of polymer blocks. The finely powdered acrylic polymer that is employed herein typically has a mean particle size of 0.3 to 1.0 and preferably 0.4 to 0.6 μm. Typically, amounts of 0.05 to 0.15 and preferably 0.08 to 0.13 parts by weight of the finely powdered acrylic polymer per 100 parts by weight of the toner particles are employed. Amounts less than 0.05 parts by weight are undesirable, because the number of poorly charged particles increases, so that a decrease of image density and image fogging occur, and moreover, because the cleaning characteristics deteriorate, so that the residual toner cannot be completely removed. On the other hand, amounts greater than 0.15 parts by weight are also undesirable, because in that case the flowability of the toner composition exhibits a pronounced drop, consequently, the efficacy of feeding from the hopper as well as the flowability within the developing unit deteriorate, and therefore image fogging and scattering of toner are prone to occur.

The acrylic polymer can be a homopolymer of acrylic or methacrylic monomers, or can be a copolymer of acrylic or methacrylic monomers and free-radical polymerizable monomers. Examples of the acrylic or methacrylic monomers include acrylic acid, methyl acrylate, ethyl acrylate, n-butyl acrylate, isobutyl acrylate, n-octyl acrylate, 2-ethylhexyl acrylate, dodecyl acrylate, stearyl acrylate, cyclohexyl acrylate, phenyl acrylate, 2-hydroxypropyl acrylate, diethylaminoethyl acrylate, acrylamide, acrylonitrile, methacrylic acid, methyl methacrylate, ethyl methacrylate, n-butyl methacrylate, isobutyl methacrylate, n-octyl methacrylate, 2-ethylhexyl methacrylate, dodecyl methacrylate, stearyl methacrylate, cyclohexyl methacrylate, phenyl methacrylate, 2-hydroxypropyl methacrylate, diethylaminoethyl methacrylate, and the like. Examples of the free-radical polymerizable monomers include styrene derivatives such as styrene, α-methylstylene, o-methylstylene, p-methylstylene, p-methoxystyrene, and p-chlorostyrene; olephinically unsaturated carboxylic acids such as maleic acid, fumaric acid, crotonic acid, and itaconic acid, or alkyl esters of these carboxylic acids; olephinic monomers such as ethylene, propylene, and butadiene; and vinyl compounds such as vinyl acetate, vinyl chloride, vinylidene chloride, vinylpyrrolidone, and vinylnaphthalene.

The silica particles that are employed herein typically have a primary mean particle size of 0.01 to 0.04 and preferably 0.02 to 0.03 μm. Preferably, hydrophobic silica particles are used. The weight ratio of silica to acrylic polymer is typically from 1.0 to 5.0:1 and preferably from 2.5 to 3.5:1. Ratios less than 1:1 are undesirable, because the overall flowability of the toner composition and the maintenance of dispersion of the finely powdered acrylic polymer will decrease. On the other hand, ratios greater than 5.0:1 are also undesirable, because image tailing will occur with a decrease in the amount of charge, and moreover, because the control of toner density by means of a sensor will become unstable.

The toner particles that are employed herein can be those which contain additives such as colorants and the like, dispersed in the resinous binder as described below. Examples of the resinous binders include styrene polymers and copolymers, acrylic polymers and copolymers, styrene-acrylic copolymers, polyolefins such as polyethylene, chlorinated polyethylene, polypropylene, and ionomer, vinyl chloride polymers and copolymers such as polyvinylchloride, polyester resins, polyamide resins, polyurethane resins, polyether resins, epoxy resins, diallyl phthalate resins, silicone resins, ketone resins, polyvinylbutyral resins, phenol resins, xylene resins, rosin-modified phenol resins, rosin-modified maleate resins, rosin esters, and cellulose resins. The resinous binder that is employed herein has a weight average molecular weight of 30,000 to 200,000 and preferably 50,000 to 150,000, and a softening point of 50° to 200° C. and preferably 70° to 170° C. One or more kinds of the above-mentioned resinous binders can be used, depending upon the fixing process or any other characteristics required. Because of high grindability and easy control of molecular weight distribution, styrene polymers and copolymers, acrylic polymers an copolymers, and styrene-acrylic copolymers are preferred with the styrene-acrylic copolymers being most preferred.

To improve the frictional charging characteristics of toner particles, polyester resins, polyether resins, epoxy resins, rosin-modified phenol resins, rosin-modified maleate resins, rosin esters, and cellulose resins can be used for the resinous binders. Also, when the toner particles constitute pressure-fixative toner, the resinous binders can be polyolefins, polyamide resins, or other polymers and copolymers, the composition of which can readily be modified. These resins, polymers and copolymers may be used in admixture with other polymers and copolymers such as polyvinyl acetate, ethylene-vinylacetate copolymers, hydrogenated polyethylene, and hydrogenated rosin esters, or aliphatic, alicyclic, or aromatic petroleum resins.

Examples of the colorants which are dispersed in the resinous binder include carbon black, lampblack, chrome yellow, Hansa yellow, benzidine yellow, threne yellow G, quinoline yellow, permanent orange GTR, pyrazolone orange, Vulcan orange, Watchung Red, permanent red, Brilliant Carmine 3B, Brilliant Carmine 6B, du Pont oil red, pyrazolone red, Lithol Red, Rhodamine B Lake, Lake Red C, rose bengal, aniline blue, ultramarine blue, chalco oil blue, methylene blue chloride, phthalocyanine blue, phthalocyanine green, malachite green oxalate, and various oil-soluble dyes such as C.I. Solvent Yellow 60, C.I. Solvent Red 27, and C.I. Solvent Blue 35. One or more kinds of these colorants are used to obtain adequate density of toner images, for example, in an amount of 1 to 30 and preferably 2 to 20 parts by weight per 100 parts by weight of the resinous binder.

When the toner particles constitute magnetic toner, a magnetic material can be used, together with or in place of the colorant. The magnetic materials are those which have magnetic properties or can be magnetized, including ferromagnetic metals such as iron, cobalt, and nickel, alloys or compounds of these metals, and other metals such as manganese, e.g., ferrite, magnetite, and the like. The magnetic material that is employed herein has a mean particle size of 0.1 to 1 μm. One or more kinds of these magnetic materials can be used, typically in an amount of 5 to 70 and preferably 20 to 50 parts by weight per 100 parts by weight of the resinous binder.

The toner particles may contain a charge-controlling agent in order to control their charges. Examples of the charge-controlling agents include oil-soluble dyes such as Nigrosine base, oil black, and Spiron black; metallic soaps which are salts of various carboxylic acids, such as naphthenic acid, salicylic acid, octylic acid, fatty acid, and resin acid, with metals such as manganese, iron, cobalt, nickel, lead, zinc, cerium, and calcium; metal-containing azo dyes; pyrimidine compounds; and alkylsalicylate metal chelate compounds. Typically, amounts of 0.1 to 5 parts by weight of the charge-controlling agent per 100 parts by weight of the resinous binder are employed.

The toner particles may contain an offset inhibitor in order to prevent them from adhering to fixing rollers. Examples of the offset inhibitors include low molecular weight polypropylene, low molecular weight polyethylene, various kinds of wax such as paraffin wax, low molecular weight polyolefin prepared from olefin monomers containing 4 or more carbon atoms, fatty acid amides, silicone oil, and the like. The offset inhibitor is preferably contained in an amount of 0.5 to 15 parts by weight per 100 parts by weight of the resinous binder.

The toner particles that are employed herein typically have a mean particle size of 1 to 30 and preferably 5 to 25 μm.

The toner composition of this invention can be useful for either a single developer or binary developer. When used as a single developer, the toner particles containing the magnetic material are mixed with the finely powdered acrylic polymer and finely powdered silica to form the single developer. When used as a binary developer, a mixture consisting of toner particles, finely powdered acrylic polymer, and finely powdered silica is further blended with carriers to form the binary developer. The carriers that are employed herein may be uncoated carriers such as glass beads, oxidized or unoxidized iron powder, or ferrite; or may also be coated carriers in which a magnetic material such as iron, nickel, cobalt, or ferrite, is coated with resins, polymers or copolymers such as acrylic polymers or copolymers, fluorocarbon resins, polyester resins, silicone resins, epoxy resins, or melamine resins. These carriers typically have a mean particle size of 50 to 2,000 μm. When the developer comprising the toner composition and the carriers is used, the concentration of toner composition is within the range of 2 to 15 percent by weight.

The toner composition prepared in the above manner has adequate durability and moisture resistance in practical use, and even under conditions of continuous or high-speed copying, when the toner composition must be frequently replenished from the hopper and sharp fluctuations of toner consumption occur, the characteristics of the toner exhibit little change, with charge stability, cleaning characteristics, and flowability being stably maintained, permitting the formation of high quality images.

In the toner composition of this invention, finely powdered silica is dispersed so as to cover the toner particles bearing uniformly adherent finely powdered acrylic polymer on their surfaces. Therefore, the charge control characteristics of the finely powdered acrylic polymer are effectively manifested and the overall flowability of the toner composition is stably maintained, so that the characteristics of the toner composition undergo little change, thereby attaining invariant stable developing and cleaning characteristics.

EXAMPLES AND COMPARATIVE EXAMPLES

To 100 parts by weight of a styrene-acrylic copolymer as a resinous binder were added 10 parts by weight of carbon black as a colorant, 1 part by weight of a negative polarity dye as a charge-controlling agent, and 1.5 parts by weight of low molecular weight polypropylene as an offset inhibitor. After fusion and kneading by a conventional method, this mixture was cooled and ground to obtain toner particles with a mean particle size of 15 μm. Then, by varied addition procedures and with varied final concentrations, the toner particles obtained in this manner were mixed with PMMA particles (the mean particle size thereof being 0.4 μm) as a finely powdered acrylic polymer and with hydrophobic silica (the mean particle size thereof being 16 μm, R972 supplied by Nippon Aerosil Co.), thus preparing a series of toner compositions. Each of the toner compositions obtained in this manner was mixed with a ferrite carrier having a mean particle size of 100 μm to form a developer, and the charging characteristics of these various developers were evaluated. Furthermore, using each of these developers, 70,000 copies were continuously taken both at ordinary temperature and humidity (20° C., 60%) and at high temperature and humidity (35° C., 80%) with a electrophotographic copying machine (DC-3285, manufactured by Mita Kogyo Co., Ltd.) modified so as to effect toner density control by means of a magnetic sensor, and the resulting picture quality characteristics were investigated in each case.

The results of these tests are shown in Tables 1 and 2, wherein samples 1, 12, and 13 correspond to the preferred examples of this invention and the other samples correspond to the comparative examples.

TABLE 1

(20° C., 65%)

| Sample No. | Initial weight ratio of toner particles to acrylic polymer | Final concentration of acrylic polymer (parts by weight) | Weight ratio of silica to acrylic polymer | Flow-ability | Charging characteristics | Scattering of toner | Fogging of image | Cleaning characteristics | Note |
|---|---|---|---|---|---|---|---|---|---|
| 1 | 40:1 | 0.1 | 3:1 | ○ | 0 | ○ | ○ | ○ | |
| 2 | 40:1 | 0.1 | No silica added | X | 20 | X | X | Δ | Ceased dropping from hopper after taking 5,000 copies |
| 3 | 60:1 | 0.1 | 3:1 | Δ | 10 | Δ | X | Δ | |
| 4 | 25:1 | 0.1 | 3:1 | Δ | 10 | Δ | X | Δ | |
| 5 | — | 0.1 | 3:1 | X | 20 | X | X | Δ | Ceased dropping from hopper after taking 5,000 copies |
| 6 | 40:1 | 0.04 | 3:1 | Δ | 40 | Δ | X | Δ | |
| 7 | 40:1 | 0.20 | 3:1 | X | 0 | Δ | Δ | X | Ceased dropping from hopper after taking 10,000 copies |
| 8 | 40:1 | 0.15 | 6:1 | ○ | 30 | X | X | Δ | |
| 9 | 40:1 | 0.1 | 0.5:1 | X | 0 | X | X | Δ | Ceased dropping from hopper after taking 5,000 copies |
| 10 | 40:1 | 0.1 | 3:1 | Δ | 0 | Δ | ○ | Δ | |
| 11 | — | 0.1 | 3:1 | Δ | 0 | X | X | Δ | |
| 12 | 40:1 | 0.06 | 3:1 | ○ | 3 | ○ | ○ | ○ | |
| 13 | 40:1 | 0.1 | 4:1 | ○ | 0 | ○ | ○ | ○ | |
| 14 | — | 0.1 | 3:1 | Δ | 3 | Δ | ○ | Δ | |

TABLE 2

(35° C., 85%)

| Sample No. | Initial weight ratio of toner particles to acrylic polymer | Final concentration of acrylic polymer (parts by weight) | Weight ratio of silica to acrylic polymer | Flow-ability | Charging characteristics | Scattering of toner | Fogging of image | Cleaning characteristics | Note |
|---|---|---|---|---|---|---|---|---|---|
| 1 | 40:1 | 0.1 | 3:1 | ○ | 0 | ○ | ○ | ○ | |
| 2 | 40:1 | 0.1 | No silica added | X | 25 | X | X | Δ | Ceased dropping from hopper after taking 5,000 copies |
| 3 | 60:1 | 0.1 | 3:1 | Δ | 10 | Δ | X | Δ | |
| 4 | 25:1 | 0.1 | 3:1 | Δ | 15 | Δ | X | Δ | |
| 5 | — | 0.1 | 3:1 | X | 25 | X | X | Δ | Ceased dropping from hopper after taking 5,000 copies |
| 6 | 40:1 | 0.04 | 3:1 | Δ | 40 | Δ | X | Δ | |
| 7 | 40:1 | 0.20 | 3:1 | X | 0 | Δ | Δ | X | Ceased dropping from hopper after taking 10,000 copies |

TABLE 2-continued

| Sample No. | Initial weight ratio of toner particles to acrylic polymer | Final concentration of acrylic polymer (parts by weight) | Weight ratio of silica to acrylic polymer | Flowability (35° C., 85%) | Charging characteristics (35° C., 85%) | Scattering of toner (35° C., 85%) | Fogging of image (35° C., 85%) | Cleaning characteristics (35° C., 85%) | Note |
|---|---|---|---|---|---|---|---|---|---|
| 8 | 40:1 | 0.15 | 6:1 | Δ | 35 | X | X | Δ | |
| 9 | 40:1 | 0.1 | 0.5:1 | X | 0 | X | X | Δ | Ceased dropping from hopper after taking 5,000 copies |
| 10 | 40:1 | 0.1 | 3:1 | Δ | 10 | X | Δ | Δ | |
| 11 | — | 0.1 | 3:1 | X | 0 | X | X | Δ | Ceased dropping from hopper after taking 10,000 copies |
| 12 | 40:1 | 0.06 | 3:1 | ○ | 5 | ○ | Δ | Δ | |
| 13 | 40:1 | 0.1 | 4:1 | ○ | 0 | ○ | Δ | ○ | |
| 14 | — | 0.1 | 3:1 | Δ | 5 | X | Δ | Δ | |

In Tables 1 and 2, the initial weight ratio of toner particles to acrylic polymer indicates the weight ratio of toner particles to finely powdered acrylic polymer in the initial mixture, before the content of acrylic polymer was adjusted to the final concentration. Except for samples 5, 11, and 14, the initial toner mixture consisting of toner particles and finely powdered acrylic polymer was thereafter mixed with additional toner particles in order to achieve the final concentration of acrylic polymer. Except for sample 10, wherein the finely powdered acrylic polymer and finely powdered silica were added simultaneously, the finely powdered silica was added after the mixture of toner particles and finely powdered acrylic polymer had been prepared. The concentration of finely powdered acrylic polymer is expressed in terms of parts by weight per 100 parts by weight of the toner particles. In the preparation of sample 5, the finely powdered acrylic polymer and finely powdered silica were simultaneously added to the entire amount of toner particles to be contained in the final product. Sample 11 was prepared by first adding the finely powdered silica to the entire amount of toner particles and afterward adding the finely powdered acrylic polymer, while sample 14 was prepared by first adding the finely powdered acrylic polymer to the entire amount of toner particles and afterward adding the finely powdered silica.

The criteria for the evaluation of flowability indicated in these tables were as follows:

O Both replenishment from the hopper and flowability of the developer within the developing unit during development were excellent, entailing no problems;

Δ Replenishment from the hopper and flowability of the developer within the developing unit gradually deteriorated; and X The toner ceased dropping from the hopper, and development became impossible.

The charging characteristics indicated in the tables were evaluated by measurement of the distribution of charge carried by the toner compositions after mixed with the carrier, and represent the proportion of toner particles carrying a charge of opposite polarity.

Scattering of the toner was assessed by observing the contamination of the zone below the developing unit and the soiling of the reverse faces of the copies, and was graded according to the following scale:

No scattering;

Δ Almost no scattering; and

X Soiled copies appeared frequently.

Cleaning characteristics were assessed on the basis of the images on the copies, and was graded according to the following scale:

No fogging;

Δ Almost no fogging; and

X Frequent occurrence of fogging.

As can be seen from Tables 1 and 2, toner composition with excellent characteristics can be obtained by first mixing toner particles and finely powdered acrylic polymers at a prescribed ratio, subsequently admixing additional toner particles in order to adjust the content of finely powdered acrylic polymers to the desired final concentration, and finally admixing a specified amount of finely powdered silica. The toner composition of this invention has improved charging, and cleaning characteristics as well as improved durability, which permit excellent image formation over long periods of continuously repeated copying, and also have significantly improved moisture resistance.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. The toner composition prepared by the method comprising the steps of:

(a) adding finely powdered acrylic polymer particles to toner particles and mixing them with each other to form a toner mixture, the weight ratio of toner particles to acrylic polymer particles being within the range of 30 to 50:1, (b) diluting the toner mixture by adding toner particles to obtain a mixture of the toner particles with the finely powdered acrylic polymer particles adhering to their surfaces, the concentration of acrylic polymer ranging from 0.05 to 0.15 parts by weight per 100 parts by weight of the toner particles; and (c) adding finely powdered silica particles to the mixture formed in the step (b) and mixing them with each other to form the toner composition, the weight ratio of silica to acrylic polymer being within the range of 1 to 5:1.

2. A toner composition according to claim 1, wherein the concentration of acrylic polymer ranges from 0.08 to 0.13 parts by weight per 100 parts by weight of the toner particles.

3. A toner composition according to claim 1, wherein the weight ratio of silica to acrylic polymer is within the range of 2.5 to 3.5:1.

4. A toner composition according to claim 1, wherein the toner particles have a mean particle size of 1 to 30 μm.

5. A toner composition according to claim 1, wherein the finely powdered acrylic polymer particles have a mean particle size of 0.3 to 1.0 μm.

6. A toner composition according to claim 1, wherein the finely powdered silica particles have a mean primary particle size of 0.01 to 0.04 μm.

7. A method for preparing a toner composition comprising the steps of:

(a) adding finely powdered acrylic polymer particles to toner particles and mixing them with each other to form a toner mixture, the weight ratio of toner particles to acrylic polymer particles being within the range of 30 to 50:1;

(b) diluting the toner mixture by adding toner particles to obtain a mixture of the toner particles with the finely powdered acrylic polymer particles adhering to their surface, the concentration of acrylic polymer ranging from 0.05 to 0.15 parts by weight per 100 parts by weight of the toner particles; and (c) adding finely powdered silica particles to the mixture formed in step (b) and mixing them with each other to form the toner composition, the weight ratio of silica to acrylic polymer being within the range of 1 to 5:1.

8. A method according to claim 7, wherein the toner mixture obtained in the step (a) is diluted to obtain a concentration of acrylic polymer ranging from 0.08 to 0.13 parts by weight per 100 parts by weight of the toner particles.

9. A method according to claim 7, wherein the finely powdered silica particles are added to the toner mixture formed in the step (b) at a weight ratio of silica to acrylic polymer ranging from 2.5 to 3.5:1.

* * * * *